United States Patent [19]

Nelson

[11] 4,030,397

[45] June 21, 1977

[54] ELECTRICALLY AMPLIFIED MUSICAL INSTRUMENT CONTROL APPARATUS

[76] Inventor: Walter E. Nelson, 1833 Shaw Ave., Pittsburgh, Pa. 15217

[22] Filed: Nov. 21, 1975

[21] Appl. No.: 634,233

Related U.S. Application Data

[63] Continuation of Ser. No. 262,058, June 12, 1972, abandoned.

[52] U.S. Cl. ..... 84/1.22; 84/1.24; 84/464; 84/DIG. 25

[51] Int. Cl.[2] ..... G10H 1/00; G10H 5/00

[58] Field of Search ..... 84/1.01, 1.04, 1.11, 84/1.16, 1.17, 1.19, 1.22, 1.24, 423–426, 433, 464, DIG. 25

[56] References Cited

UNITED STATES PATENTS

| | | | |
|---|---|---|---|
| 3,185,755 | 5/1965 | Williams et al. | 84/1.24 |
| 3,196,729 | 7/1965 | Burns et al. | 84/1.16 X |
| 3,213,181 | 10/1965 | Snoddy et al. | 84/1.19 |
| 3,217,079 | 11/1965 | Murrell | 84/1.16 |
| 3,270,119 | 8/1966 | Griffith | 84/1.01 |
| 3,482,029 | 12/1969 | Sines | 84/1.16 |
| 3,493,669 | 2/1970 | Elbrecht et al. | 84/1.16 |
| 3,526,701 | 9/1970 | Machanian | 84/1.11 |
| 3,530,224 | 9/1970 | Plunkett et al. | 84/1.11 |
| 3,585,893 | 6/1971 | Arseneault | 84/1.17 |
| 3,591,699 | 7/1971 | Cutler | 84/1.11 |
| 3,604,852 | 9/1971 | Weintraub | 84/464 X |
| 3,623,392 | 11/1971 | Boyer | 84/464 |
| 3,673,304 | 6/1972 | Dudas | 84/1.01 |
| R26,533 | 3/1969 | Cookerly et al. | 84/1.16 |

*Primary Examiner*—Stanley J. Witkowski
*Attorney, Agent, or Firm*—Roylance, Abrams, Berdo & Kaul

[57] ABSTRACT

An electrically amplified musical instrument control apparatus for combining control of a broad range of special sound effects in a single housing and enabling a musician to produce single or multiple special sound effects as desired with a guitar while indicating the operational status of each special effect and providing a foot-operated volume control.

9 Claims, 5 Drawing Figures

ELECTRICALLY AMPLIFIED MUSICAL INSTRUMENT CONTROL APPARATUS

CROSS-REFERENCE TO RELATED APPLICATIONS

This is a continuation of application Ser. No. 262,058, filed June 12, 1972, and now abandoned

BACKGROUND OF THE INVENTION

This invention relates to the field of electrically amplified musical instrument control apparatus and more particularly to a special sound effect control unit.

In the past, a musician playing an electrically amplified instrument, such as a guitar, was required to set up numerous individual special sound effect units prior to a performance to achieve the full musical capability of his instrument. Typical arrangements are disclosed in U.S. Pat. Nos. 3,270,119; 3,482,029 and 3,530,224. During the performance it was frequently necessary for the musician to physically change the electrical connections of the individual units to employ a desired special effect unit which was distracting to the audience and thereby diminished the showmanshiplike manner of the performance. The electrical connections of the various individual and sometime non-compatible units frequently precluded the simultaneous use of the entire range of special effect units and provided an unsightly appearance to the audience as well. Furthermore, the musician was not able to tell at a glance which of the special effect units were in operation.

SUMMARY OF THE INVENTION

This invention relates to a new and improved electrically amplified musical instrument control apparatus having a plurality of special sound effect circuits which may be selectively operated by a corresponding switch positioned on the apparatus for producing special sound effects in any desired combination. The apparatus mounts a foot-operated volume control for regulating the output of the apparatus and indicating means on the apparatus for indicating the operational status of each of the special effect units so controlled.

DESCRIPTION OF THE PREFERRED EMBODIMENT

Figure 1:
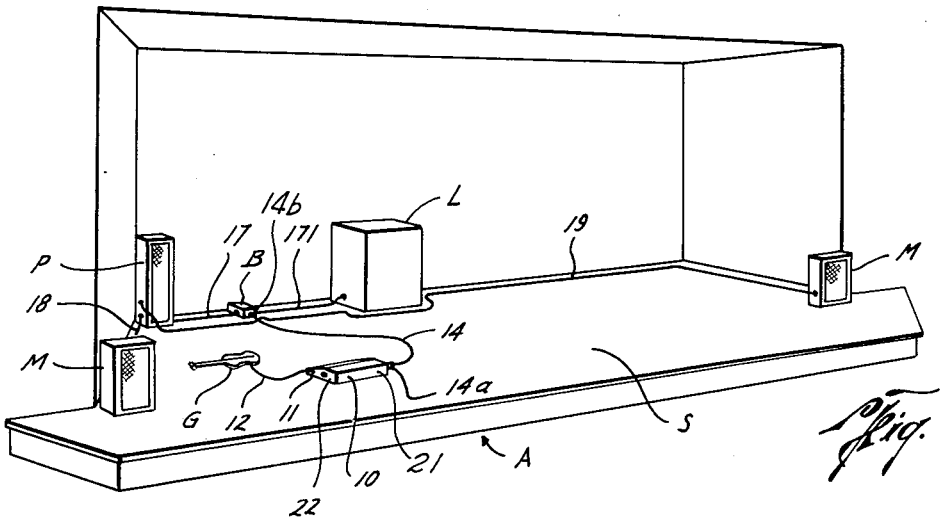
FIG. 1 is a schematic illustration of a stage having the control apparatus of the present invention positioned thereon in operational position.

The electrically amplified musical instrument control apparatus, generally designated A in the Figures, includes a housing 10 and is illustrated positioned on a performing stage S in FIG. 1. The housing 10 includes an input terminal 11 electrically connected by a flexible insulated conductor cable 12 with a desired musical instrument, such as, by way of illustration and not limitation, a guitar G. The guitar G produces an electrical output signal in response to the playing thereof by a musician (not illustrated) which is communicated to the input terminal 11 by the cable 12 as is old and well known in the art.

Figure 2:
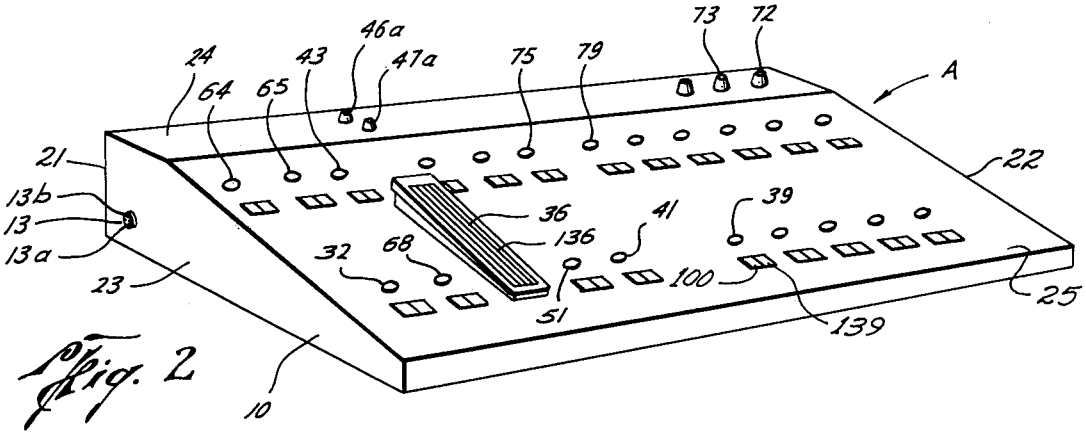
FIG. 2 is a perspective view illustrating the array of control switches and indicating means positioned on the control apparatus of the present invention.
Figure 4:
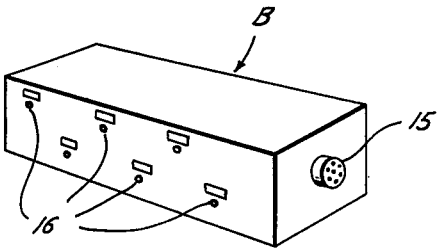
FIG. 4, is a perspective view of a remote outlet junction box of the present invention.

As illustrated in FIG. 2, the housing 10 further includes a multi-conductor output terminal 13 which is eventually electrically connected with a transducer amplifier and ultimately to the remote speaker means M for converting the electrical signal at the terminal 13 into audible sound as is well known in the art. A flexible insulated multi-conductor electrical cable 14 is connected at a first end **14*a* with the terminal 13 and with a second end 14*b* connected to either a primary amplifier P or as illustrated in FIG. 1, to a remote outlet junction box B. The junction box B enables the output terminal 13 to be electrically connected with the primary amplifier P and other equipment at the rear of the stage S. As illustrated in FIG. 4, the junction box B includes a multi-conductor input terminal 15 connected with the end 14*b* of the cable 14, a plurality of outlet jacks 16 and suitable internal circuitry (not illustrated) for effecting a desired electrical hook-up. In the electrical hook-up illustrated in FIG. 1, a flexible multi-conductor cable 17 is connected between the junction box B and the primary amplifier P which is in turn electrically connected at its output terminals through flexible insulated conductor wires 18 and 19 to the speaker means M arranged upon the stage S to achieve the desired acoustical effect. The amplifier P may be positioned in a speaker housing. Suitable electrical circuitry may also be provided in the box B to enable connection between the output jacks 16 and a Leslie Unit speaker L by a cable 171**.

The housing 10 includes upstanding front wall 20 and back wall 21 and side walls 22 and 23 mounting the input terminal 11 and the output terminal 13 thereon, respectively. The housing 10 is peferably formed with an upper wall 24 having at least a portion thereof 25 slanted or angled to position the portion 25 at substantially a right angle to the line of sight of the operating musician for enhancing visibility of the angled upper wall 25. A removable bottom wall (not illustrated) is provided for protecting the electrical apparatus positioned within the housing 10.

Figure 5:
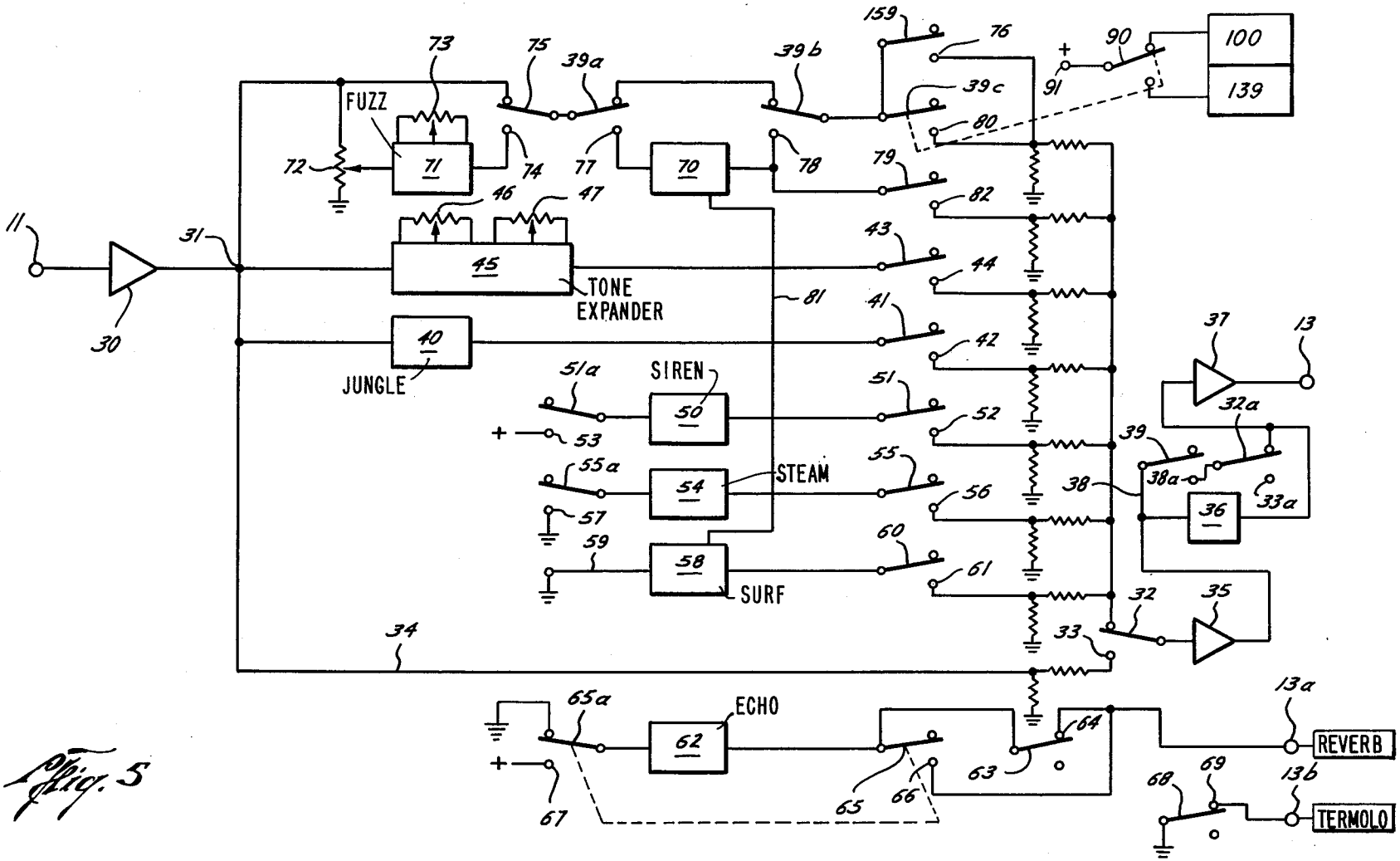
FIG. 5 is a block diagram of the electrical system of one embodiment of the electrically amplified musical instrument control apparatus of the present invention.

One embodiment of the suitable electrical circuitry located in the housing 10 is illustrated with the inlet terminal 11 being shown near the left side and the output terminal 13 being shown near the right side of FIG. 5. As the detailed electrical circuitry to produce each of the special sound effects is known and may be purchased commercially, applicant will refer to such circuitry by the common name employed by musicians in referring to the special sound effect produced.

The electrical output signal from the guitar G transmitted to the input terminal 11 is first conducted through a pre-amplifier 30 where a suitable gain in the strength of the electrical signal is effected. The enhanced signal is then directed to a common electrical junction, designated 31, for thereafter enabling the signal to be conducted through various different electrical circuits to the output terminal 13.

Should the musician desire to play the guitar G without employing any special sound effects, a special effect on-off master switch, designated at 32, is moved to the off position where it establishes electrical contact with the switch contact point, designated at 33, enabling the passage of the electrical signal through a conductor circuit 34 bypassing the special effect circuits. Any electrical signal passing through the switch 32 is first processed in a first or initial summing amplifier, designated at 35, prior to passing through a foot-pedal operated volume control means for selectively controlling the output electrical signal present at the output terminal 13 and convertible into audible sound by the speaker means M. The regulated electrical signal output of the volume control means 36 is then processed through a second summing amplifier circuit 37 for electrically adding the amplitude of the electrical output signal conducted through the volume control unit 36 and an electrical signal conducted around the volume control 36 in the electrical conductor 38 having switches, designated 39 and 32*a* arranged in series connection therein. The master switch 32, like all of the switch means utilized herein, is preferably a multi-contact foot-operated switch spring biased to an extended position which alternately switches between on and off positions when depressed and when thrown to the off position establishes contact with the pole 33 and also moves the second contact of switch 32, designated switch 32*a*, to effect contact with the pole 33*a* to open and thereby break continuity of the circuit 38 to block passage of the electrical signal through the circuit 38 to the second summing amplifier 37. It will be immediately appreciated to those skilled in the art that all electrical signals passng through the switch 32 will be conducted in a similar manner to the output terminal 13 and that operation of switch 39 and 32 can bypass an electrical signal past the volume control 36.

When the musician desires to employ the special effect circuit commonly referred to as "screaming bird" or "jungle", and designated 40 in FIG. 5, it is only necessary that the master special effects switch 32 be moved to the on position, as illustrated, and as is required when it desired to operate any special effect control and in this instance, a jungle or screaming bird switch 41 is also moved from the open position (illustrated) to the closed position for enabling the electrical signal to pass from the conduit junction 31 through the circuit 40 where a desired signal change is effected and then conducted through the switch 41 to the switch 32 and on to the output terminal 13 in the manner set forth above.

Should the musician desire to employ a special effect commonly called "tonex" or more properly "tone expander", a tonex switch, designated at 43, is moved from the open position illustrated to the closed position establishing electrical contact with a switch pole 44 which, when the switch 32 is in the open position illustrated, will enable the electrical signal to pass from the junction 31 through a tonex circuit, designated 45, which effects the desired special effect change in the electrical signal conducted through the switch 32 and on to the output terminal 13. The tonex circuit 45 is normally provided with two independent adjustments for its internal circuitry that are designated "bright" and "mellow" and which are indicated at 46 and 47 respectively, and comprise normally rotatably adjustable rheostats operated by manipulation of the knobs 46*a* and 47*a* as illustrated in FIG. 2.

The circuitry in the housing 10 is supplied with electrical power from the amplifier P (not illustrated) including a reference positive voltage and a reference negative voltage, as is well known in the art, and which reference voltages are utilized in operating certain tone generating special effect circuits for forming electrical signals to produce desired special sound effect signals to be added to the electrical signal from the guitar G. One such special effect circuit is commonly called a "siren" special effect circuit, designated at 50, which is actuated by moving a double pole siren switch 51 from the open position illustrated to the closed position where it effects electrical contact with the pole 52 for closing the output of the circuit 50. Moving the switch 51 to establish contact with the pole 52 also moves the contact 51*a* of the switch 51 to effect electrical contact with the pole 53 which is electrically connected to the positive reference voltage supplied from the amplifier thereby effecting electrical continuity for the circuit 50 whose electrical signal output is added to that of the guitar G in the summing amplifier 35.

Another internal tone generator special effect circuit for producing an electrical signal to be added to the electrical signal from the guitar G is commonly called "steam" or "whistle,"designated at 54, which is actuated by moving the multi-contact switch 55 from the open position illustrated to the closed position which effects electrical contact with the pole 56 for closing the output of the whistle circuit 54 while simultaneously moving a second contact 55*a* of the switch 55 to contact the pole 57 which is electrically connected with the negative reference voltage provided by the amplifier P and thus effecting electrical continuity through the whistle circuit 54 and whose electrical output signal is conducted through the switch 32 where it is electrically added in the summing amplifier 35.

A third internally generated tone special effect circuit, designated 58, may be employed to effect a surf or swell sound at the speaker means M. The constant input to the swell circuit 58 is from the negative reference voltage provided by the amplifier through the electrical conductor 59 and movement of a surf switch 60 from the open position illustrated to a closed position establishing electrical contact with the pole 61 directs the electrical output signal from the surf circuit 58 to the switch 32 and the summing amplifier 35.

Another special effect mode circuit called "echo" may be developed in the block, designated 62, which is actuated in conjunction with the reverb special effect circuit located in the amplifier P as is well known in the art. The reverb special effect circuit operation is controlled from the housing 10 by the operation of an on-off reverb switch 63 which is normally in the closed position in contact with the pole 64. An insulated output terminal 13*a* is connected with the reverb circuit for normally conducting the reverb circuit to ground through the echo circuit 62 through switch 65*a* and thereby rendering it inoperative. By opening the switch 63, the reverb special effect circuit is no longer taken to ground and the reverb special effect mode is actuated. The echo special effect circuit 62 can be used in conjunction with the reverb circuit, as is well known, and is actuated by closing the switch 65 to effect electrical contact with the switch pole 66 and thereby bypassing the echo signal around the reverb switch 63 to electrically connect the echo circuit 62 with the reverb circuit in the amplifier P. Closing the multi-contact switch 65 also effects closure of the switch 65*a* effecting electrical contact with the positive reference voltage present at the pole 67 to complete the circuit.

Another special effect circuit called tremols is located in the amplifier P, but is controlled from the housing 10 by operation of a tremols switch 68 which when in the closed position illustrated establishes electrical contact with the pole 69 for grounding the tremols circuit and thereby rendering it inoperative. Movement of the switch 68 to the open position breaks the continuity of the ground of the tremols circuit which is connected to the terminal 13*b* and the switch 68 for enabling operation of the tremols circuit.

Two other special effect circuits operable simultaneously are located in the housing 10 and are called "wah-wah" or "crybaby" and "fuzz" and are designated 70 and 71, respectively. The fuzz circuit 71 is provided with a manual input voltage adjustment 72 for providing a control commonly referred to as the sustain adjustment and a second manual adjustment 73 for controlling the tone of the fuzz circuit and the output signal of which is always present at a switch pole 74. When the multi-contact fuzz switch 75 is operated to establish electrical contact with the pole 74, the contact 75*a* of the switch 75 is also operated to effect electrical connection with a switch pole 76 and electrical continuity is thereby established through a plurality of switch contacts 39*a* and 39*b* of the switch 39 in the illustrated positions for communicating the electrical output signal of the fuzz circuit 71 to the switch 32 and the summing amplifier 35.

Operation of the wah-wah mode circuit 70 is effected by moving the contacts of the wah-wah switch 39 from the open position illustrated to the closed position for directing the electrical signal present at the switch 75 through the contact 39*a* to a switch pole 77 where it will be directed into the wah-wah circuit 70 for effecting the desired change in the electrical signal from the guitar G. The output of the wah-wah circuit 70 is conducted to the switch pole 78 and the switch 79, but as the switch 79 is open and the switch contacts 39*b* and 39*c* have been moved to effect electrical contacts with the switch poles 78 and 80, electrical continuity is established and the electrical output signal from the wah-wah circuit 70 is conducted to the switch 32 and summing amplifier 35. Operation of the switch 39 also establishes continuity of the conductor 38 by effecting electrical contact with the switch pole 38*a* and thereby bypassing a portion of the output signal from the summing amplifier 35 around the volume control circuit 36.

The switch 79 is used to effect operation of one other special effect mode called "tempest" or "tornado" which employs a noise signal internally produced in the swell circuit 58 transmitted by a conductor 81 to the wah-wah circuit 70 for effecting additional change in the electrical signal. By closing the switch 79 to effect electrical contact with a switch pole 82, electrical continuity is established and the tornado signal output is conducted to the switch 32 and the summing amplifier 35.

Each of the special effect circuits are transistorized oscillating or switching circuits or the like, each of which is well known in the prior art. The circuitry associated with each one of the special effect oscillating switching circuits has heretofore been disclosed in the prior art in a plurality of reference sources, such as *Popular Electronics* magazines, and the like. Thus, for purposes of clarity and understanding of the present invention such precise circuitry need not be illustrated herein. Such electronic oscillating switching circuits are commercially available products and are sold, for example, by P.A.I.A. Electronics Inc., of Oklahoma City, Okla; Chicago Musical Instruments Co., 7373 N. Cicero, Lincolnwood, Ill. 60646; and Electro Harmonix, 8–12 West 24th Street, New York, N.Y. 10010.

Examples of some of the circuits usable as the special effects are the following:

Block 40: This is the jungle circuit (also known in the trade as screaming bird and by other names), and example of which has been described in an article entitled, "The Solid State Bird, " in *Popular Electronics* magazine.

Box 45: The Tone Expander is a bass and/or treble boost circuit, the nature of which is described in the text entitled, "Electric Guitar Amplifier Handbook, " by Jack Darr, published by Howard W. Sams & Co., Inc. (1971), at pages 21 and 22. Tone expanders of the type usable herein are shown in U.S. Pats. Nos. 3,454,702, Elbrecht, and 3,080,785, Evans.

Box 54: The steam whistle effect is available from P.A.I.A. Electronics Inc., of Oklahoma City, Okla., and has been since about 1969.

Box 58: The surf synthesizer effect is also available under this name from P.A.I.A. Electronics Inc., and has been since about 1969.

Box 62: The echo effect (also known as reverberation) is disclosed at pages 25 and 26 of the above Howard W. Sams publication and in U.S. Pats. Nos. 3,463,868, Laube, and 3,612,741, Marshall, and also in an article by J. Jacques in the February, 1970, issue of *Radio Electronics*, page 44.

Box 70: The WAH-WAH effect is available from P.A.I.A. Electronics Inc., and has been since 1969. Circuits usable to obtain this effect are also shown in U.S. Pat. No. 3,530,224, Plunkett et al, and at page 45 of the January, 1970, issue of *Popular Electronics*, in an article by J. S. Simonton, Jr.

Box 71: The fuzz effect is described at pages 25 and 26 of the above-mentioned Howard W. Sams publication, and a suitable circuit is also described in *Radio Electronics*, issue of December, 1969, page 40, in an article entitled, "Solid-State Fuzz Box".

As illustrated in FIG. 2, the appropriate foot-operated switches are preferably arranged on the portion 25 of the upper wall 24 in a desired array to provide the musician with a control panel operable with a minimum of distraction to the audience. Suitable color-coded illuminated indicating means are provided adjacent the appropriate foot-operated control switches so that a musician can readily determine the operational status of any of the special effect modes. Suitable electric circuitry controlled with additional contacts on the appropriate switch may be used to illuminate the labels or translucent panels designating the status of the various special effect circuits. An example of a circuit which can be used with each of the effects operating switches is shown in connection with the switches 39*a*, *b* and *c* for placing the WAH-WAH circuit into operation. The movable contact of a switch 90 is connected to a power source terminal 91. One fixed contact of switch 90 is connected to panel 100 and the other fixed contact of the switch is connected to a panel 139. The movable contact of switch 90 is mechanically movable with switch contact 39*a*, *b* and *c* so that when the switches are open (in the positions shown in FIG. 5), switch 90 is also in the position shown, energizing and illuminating the STANDBY panel 100 (also seen in FIG. 3). When switches 39 and 90 are moved to the opposite positions, panel 100 is de-energized and panel 139 is energized, illuminating that panel and indicating that the WAH-WAH effect is in operation. Similar circuits can be supplied for each of the panels adjacent their respective function switches in wall 25.

Figure 3:
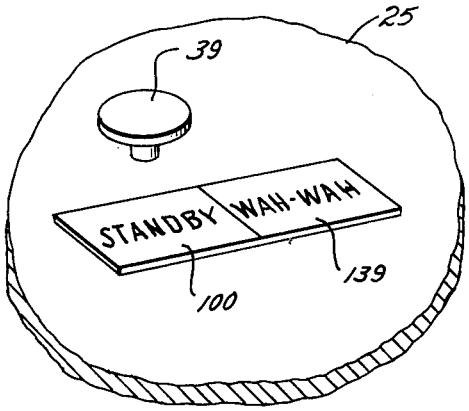
FIG. 3 is an enlarged view of the circled portion, designated 3, of FIG. 2, illustrating in greater detail the switch and indicating means.

As illustrated in FIG. 3, a white standby panel 100 and a red switch or circuit identification panel 139 may be provided for each of a plurality of switches mounted on the housing 10.

In the use and operation of the present invention, the musician will connect the housing 10 in the manner described hereinabove and illustrated in FIG. 1, prior to a performance. Thereafter, operating the appropriate switches will energize the special sound effect modes without fear of distracting the audience. The volume control circuit 36 is operated by manipulation of the foot pedal 136 in the well known manner.

While the electrical circuits designated in the various blocks are old and commercially available, special circuitry particularly adapted for use in the controlled apparatus of the present invention may be utilized in any of the blocks.

The foregoing disclosure and description of the invention is illustrative and explanatory thereof, and various changes in the size, shape and materials as well as in the details of the illustrated construction may be made without departing from the spirit of the invention.

What is claimed is:

1. An electrically amplified musical instrument control apparatus for use with a musical instrument of a type having means for producing electrical signals representative of the sounds produced by the instrument, the apparatus comprising:

a pre-amplifier electrically connected to the instrument for boosting the incoming electrical signals from the instrument, means for selectively complementing the output from the pre-amplifier, said means comprising:

a. a housing spaced apart from the instrument and having an electrical input terminal in electrical series with the pre-amplifier, b. a plurality of transistorized electronic oscillating special effect circuits disposed within said housing for introducing background distortion and to govern the intensity of the overall frequency range, c. a plurality of foot-operated switch means mounted on the outside of the housing, each one of the plurality of switch means being in electrical series with one of said special effect circuits to control the opertion thereof such that actuation of any one switch means actuates its associated effect circuit, each one of the plurality of switch means being in parallel circuit relationship with every other one of the plurality of switch means, whereby any one or more of said effect circuits is operable at any one time;

d. at least one summing amplifier disposed in said housing said amplifier being connectable in electrical series circuit relationship with each of said effect circuits, e. means in said housing for providing a visible indication of the selection of said special effects circuits;

f. an output terminal; and g. circuit means for interconnecting said electrical input terminal and said summing amplifier;

speaker means connected to the output terminal for converting the electrical output signals of the musical instrument and the means for selectively complementing into audible sound, and wherein the output from the pre-amplifier is mixed with the output from the means for selectively complementing to produce said induced background distortion.

2. The structure as set forth in claim 1, including:

an electrical conductor connecting said input terminal and said output terminal for carrying a substantially unchanged electrical signal therebetween; and at least one of said plurality of switch means electrically connected in said conductor to control operation thereof wherein operation of said switch means controls the electrical signal at said output terminal.

3. The structure as set forth in claim 2, including:

an electrical circuit disposed in said housing for producing internally generated sound effect electrical signals when actuated; and at least one of said plurality of switch means electrically connected in said circuit for producing internally generated sound effect electrical signals for controlling actuation thereof wherein operation of said switch means controls production of internally generated sound effect signals.

4. The structure as set forth in claim 1, including:

a guitar electrically connected with said input terminal of said housing wherein operation of said switch means controls production of desired special sound effects effected by the playing of the guitar.

5. The structure as set forth in claim 1, including:

volume control means mounted with said housing and electrically connected with said output terminal for selectively controlling the electrical signal present at said output terminal.

6. The structure as set forth in claim 5, wherein:

said volume control means includes a foot-operated pedal the position of which selectively controls the electrical signal present at said output terminal.

7. The structure as set forth in claim 1, including:

means for indicating the operational status of at least one of said plurality of electrical circuits, wherein the operational status of the musical instrument means is displayed.

8. The structure as set forth in claim 7, wherein said means for indicating the operational status of each of said plurality of electrical circuits includes:

an indicating means connected with at least one of said plurality of switch means for illuminating a first label associated with said one switch for designating the operating status of the circuit controlled with said switch and for illuminating a second label associated with said one switch for designating the non-operating status of the circuit controlled with said switch wherein the operation status of the circuit is indicated.

9. The structure as set forth in claim 8, wherein:

said plurality of first labels and said plurality of second labels are color-coded to distinguish therebetween.

* * * * *